US007354689B2

(12) United States Patent
Berko-Boateng et al.

(10) Patent No.: US 7,354,689 B2
(45) Date of Patent: Apr. 8, 2008

(54) PROCESS FOR PRODUCING TONER

(75) Inventors: Victor Berko-Boateng, Penfield, NY (US); Hui Chang, Pittsford, NY (US); John R. Laing, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 479 days.

(21) Appl. No.: 11/086,358

(22) Filed: Mar. 23, 2005

(65) Prior Publication Data

US 2006/0216632 A1 Sep. 28, 2006

(51) Int. Cl.
*G03G 9/08* (2006.01)

(52) U.S. Cl. ..... 430/137.1; 430/137.18; 430/137.2

(58) Field of Classification Search ..... 430/137.1, 430/137.18, 137.2
See application file for complete search history.

(56) References Cited

U.S. PATENT DOCUMENTS

| | | | |
|---|---|---|---|
| 3,526,533 | A | 9/1970 | Jacknow et al. |
| 3,590,000 | A | 6/1971 | Palermiti et al. |
| 3,800,588 | A | 4/1974 | Larson et al. |
| 3,847,604 | A | 11/1974 | Hagenbach et al. |
| 4,054,381 | A | 10/1977 | Bernhard |
| 4,265,990 | A | 5/1981 | Stolka et al. |
| 4,494,863 | A | 1/1985 | Laing |
| 4,558,108 | A | 12/1985 | Alexandru et al. |
| 4,935,326 | A | 6/1990 | Creatura et al. |
| 4,937,166 | A | 6/1990 | Creatura et al. |
| 5,111,998 | A | 5/1992 | Kanda et al. |
| 5,147,753 | A | 9/1992 | Hikake |
| 5,200,788 | A | 4/1993 | Thayer |
| 5,227,460 | A | 7/1993 | Mahabadi et al. |
| 5,229,242 | A | 7/1993 | Mahabadi et al. |
| 5,272,034 | A | 12/1993 | Kawano et al. |
| 5,376,494 | A | 12/1994 | Mahabadi et al. |
| 5,406,357 | A | 4/1995 | Nakahara et al. |
| 5,888,691 | A | 3/1999 | Laing et al. |

FOREIGN PATENT DOCUMENTS

| | | |
|---|---|---|
| GB | 1 442 835 | 7/1976 |

*Primary Examiner*—Mark A. Chapman
(74) *Attorney, Agent, or Firm*—Oliff & Berridge, PLC

(57) ABSTRACT

A waste toner reclamation process includes collecting waste toner, screening the collected waste toner, meltmixing the screened waste toner with a second toner, and extruding, grinding and classifying the mixed toner product, wherein the collected waste toner comprises a mixture of different colored toner particles.

20 Claims, No Drawings

PROCESS FOR PRODUCING TONER

BACKGROUND

The present disclosure is generally directed to processes for the reclamation, remanufacture, and reuse of waste or spent toner compositions, including color toner compositions. More specifically, the present disclosure relates to processes for the reclamation and remanufacture of used toner compositions, including color toner compositions, comprising reformulating waste toner particles with new, unused or pristine toner compositions, and reuse of the resulting toner particles with, for example, carrier particles in two component xerographic developers.

Recycling or reclamation processes of xerographic developers and toner compositions, such as toner fines, are known in the art. The prior art processes are generally directed to reclaiming and reusing waste toner particles within the confines of a printing machine, or alternatively, reclaiming and reusing waste toner particles arising from a toner manufacturing process within the confines of a toner manufacturing facility. Alternatively, known processes generally require that the waste toner particles have the same or substantially similar composition to the new toner composition with which the used toner particles are mixed.

The present disclosure, in contrast, provides, in embodiments, processes for recycling, reuse or reclamation of waste toners comprising reclaiming waste toner particles comprising of different colors, for example, from one or more printing machines in field use; co-locating the reclaimed waste toner, for example, in a reprocessing, or manufacturing facility; screening the waste toner to remove debris; meltmixing the screened waste toner in admixture with pristine or fresh toner constituents or ingredients; and processing the resulting melt mixed product in a conventional fashion, for example, grinding and classifying, to provide remanufactured toner particles which contain reclaimed or waste toner, for example, in amounts of from about 1 to about 25 weight percent, and which remanufactured toner when installed in a printing or copying machine has xerographic performance properties that are substantially the same as those obtained from toner prepared entirely from fresh toner constituents. The present disclosure, in embodiments, is applicable to reclaiming and reusing waste toner compositions that include different color toner particles, and where the waste toner compositions may be of different chemical composition.

U.S. Pat. No. 4,054,381 discloses a toner filter arrangement adapted for use in a cleaning station of a xerographic reproduction machine whereby foreign matter and other contaminates are removed from residual toner prior to its collection in a disposable or re-use container or return to the developer station. The filter arrangement comprises a housing having an input opening through which removed toner enters and an output opening through which filtered toner exits by gravity feed.

U.S. Pat. No. 5,200,788 discloses a brush auger reclaim filtration assembly incorporated into an open ended chamber contained in a printing machine. The brush auger is a toner reclaim filtration device that is rotatably mounted in the chamber to move toner and debris along a separating screen. Also contained in the housing is a mounted transport auger that rotates as it moves the reclaimed toner to the developer housing.

U.S. Pat. No. 4,494,863 discloses a toner removal device for removing residual toner and debris from a charge retentive surface after transfer of toner images from the surface.

This device is characterized by the use of a pair of detoning rolls, one for removing toner from a biased cleaner brush and the other for removing debris such as paper fibers and kaolin from the brush. The rolls are electrically biased so that one of them attracts toner from the brush while the other one attracts debris. Thus, the toner can be reused without degradation of copy quality while the debris can be discarded.

These patents relate to an apparatus for reclaiming and re-use of waste toner particles within a printing machine and are not believed to embody removal of the reclaimed toner from the machine for remanufacture with fresh toner as in the present disclosure.

Other patents of interest include U.S. Pat. Nos. 5,272,034; 5,147,753; and 5,111,998, which patents relate to conventional toner manufacturing processes wherein there is generated a waste stream of toner particles, for example, coarse or fines, and which waste toner particles are returned or recycled into an earlier step or stage in the toner manufacturing process. These patents are not believed to contemplate removal of reclaimed waste toner from a printing machine for remanufacture with fresh toner as in the present disclosure.

The aforementioned references are incorporated in their entirety by reference herein.

Conventional xerographic development processes are relatively inefficient in the utilization of toner particles in various developers, for example, up to about 20 weight percent of the toner deposited on a photoreceptor in developing latent images is typically routinely recovered, such as by cleaning, as waste toner in a toner sump. As a result, a large amount (in the thousand to millions of pounds) of toner particles are introduced into the landfills.

In an extensive study of fresh or newly manufactured toner particles and waste toner particles, the principal difference observed was that the waste toner contained, for example, paper fibers and other extraneous debris. Paper fibers and the like particulates can tend to charge to an opposite polarity from the toner particles and which lead to copy quality defects in, for example, background areas. The aforementioned U.S. Pat. No. 4,494,863, accomplishes "in-machine" electrostatic separation of particles of opposite polarity prior to return of the cleaned toner to the developer housing.

In view of the increasing costs and regulation associated with land fill and related waste disposal facilities, it is desired to recycle and to re-use waste toner particles in batch or continuous processes readily and conveniently at, for example, a central processing facility. Earlier attempts to recycle reclaimed toner particles by, for example, collecting waste toner, screening the collected waste toner to remove extraneous debris and agglomerates, conditioning the screened waste toner with surface additives, repackaging, and reusing the conditioned toner in a marking process, proved to be difficult and typically ineffective in reproducibly providing toner particles with the requisite triboelectric, conductivity, and flow properties necessary for high copy quality and high volume printing machine performance.

In this respect, at least U.S. Pat. No. 5,888,691 discloses a process for reclaiming, remanufacturing and reusing waste toner particles. The disclosed process comprises collecting waste toner, screening the collected waste toner, melt mixing the screened waste toner with a second toner, and grinding and classifying the melt mixed toner product.

SUMMARY

Despite these known processes, there has been a long sought need for an economical, efficient and environmentally efficacious means for producing remanufactured toner particle products from waste toner materials that would otherwise be destined for landfill disposal. This need is particularly great in the context of color printing systems, where the sump collector includes toner particles from more than one type of new toner composition. That is, in many systems, a single sump collector is provided, which thereby accumulates toner particles from each of the different color toner compositions used in the system. This sump can thus include multiple different composition toner particles, and different relative amounts of those compositions based on the type and color of printing that has been conducted. This situation poses the additional problem that reuse of the waste toner would appear to require separation not only of the toner particles from other materials that may be present (such as paper fibers and the like), but also separation of each specific toner composition from the others.

The present disclosure, in embodiments, provides toner particle remanufacturing processes that address the above needs. In embodiments, processes are provided that reduce or eliminate land fill waste streams arising from toner manufacturing processes and toner reclamation schemes, which are particularly applicable to color toner compositions.

In particular, the present disclosure provides a process comprising:

collecting waste toner;

screening the collected waste toner;

meltmeltmixing the screened waste toner with a second toner, and extruding, grinding and classifying the mixed toner product, wherein the collected waste toner comprises a mixture of different colored toner particles.

DETAILED DESCRIPTION OF PREFERRED EMBODIMENTS

The preparative processes of the present disclosure may be used to process and prepare a variety of toner particulate materials, including reclaimed toner particles for use in remanufactured liquid and dry developer marking applications in a cost efficient manner. A particularly salient advantage of the present disclosure is that the processes thereof afford control over the toner particle performance and physical properties and thereby overcome many of the problems and disadvantages of prior art recycling and reclamation processes. Another particularly salient advantage of the present disclosure is that the processes can be used to reclaim waste toner mixtures of different colors and/or different compositions, without first separating that mixture into its component toner colors or compositions.

In embodiments, the present disclosure provides a toner remanufacture and reuse process comprising: collecting waste toner; screening the collected waste toner; meltmixing the screened waste toner with a second toner material comprising, for example, fresh toner constituents comprising resin, colorant, and optional additives such as charge additives, surface additives, and the like, in a proper ratio to form a toner, and preblend, extrude and grinding and classifying the mixed toner product.

In other embodiments, there is provided a toner remanufacture and reuse process comprising:

collecting waste toner from at least one printing machine;

screening the collected waste toner to remove extraneous debris to afford screened waste toner;

meltmixing, for example, in an extruder or a Banbury/two roll mill apparatus, the screened waste toner in admixture with fresh toner constituents comprising a resin, a colorant, and optional additives to provide a mixed product; and grinding and optionally classifying the melt mixed product to provide remanufactured toner particles.

In embodiments, the remanufactured toner can be, if desired, further treated with various surface additives to ensure the toner has and maintains certain physical and performance properties, and which properties are required for high performance in a dry or liquid marking application and as illustrated herein. In embodiments, one or more surface additives, for example, from 1 to about 10 surface additives, may be applied to the remanufactured toner particles. Examples of surface additives include, but are not limited to, flow additives such as fumed silicas and the like particles, charge additives such as quaternary ammonium salts, and release agents or waxes such as UNILIN® waxes, and mixtures thereof, and as illustrated herein.

In embodiments, the waste or reclaimed toner particles to be remanufactured with fresh toner ingredients are preferably obtained from the same or similar printing machines or models. In these embodiments, the extent and difficulty in reconditioning the remanufactured toner particles will be minimized if the reclaimed toner material has a composition that is the same or similar composition or origin as that of the fresh toner ingredients to be used. However, the disclosure is not limited to the embodiments where the toner particles come from the same or similar printing machines or models. Rather, the processes described herein can be equally applied to reclaiming waste toner particles that come from a variety of similar and/or different printing machines or models, so long as the various toner particles are compatible with each other.

In embodiments, the waste toner particles preferably include toner particles having at least two different colorants, and preferably being of at least two different colors. Thus, for example, the waste toner particles can be a mixture of black toner particles and a highlight color toner particles, such as cyan toner particles, magenta toner particles, yellow toner particles, black toner particles, blue toner particles, red toner particles, yellow toner particles, and the like; can be a mixture of at least two different toner compositions of the same color, such as at least two different black toner compositions, at least two different cyan toner compositions, at least two different magenta toner compositions, at least two different yellow toner compositions, and the like; can be a mixture of at least two different colored (i.e., non-black) toner compositions, such as a mixture of at least two toner compositions selected from cyan, magenta, yellow and the like toner compositions and the like. In embodiments, the waste toner particles can be a mixture of at least three different colored toner compositions, such as a mixture of cyan, magenta, and yellow toner compositions. In still other embodiments, the waste toner particles can be a mixture of at least four different colored toner compositions, such as a mixture of black, cyan, magenta, and yellow toner compositions or a mixture of black, blue, red, and yellow toner compositions.

Such mixtures are preferred, in embodiments, because it was not previously believed that different toner compositions, and particularly different colored toner compositions, could be mixed together and then recycled to form a single toner composition with printing and performance characteristics that are comparable to a completely new toner composition. Unexpectedly, the processes of the present disclosure allow for reclamation and remanufacturing of mixtures of toner compositions to form a single final toner composition, where any differences in the waste toner particles, such as color, are masked by the new toner composition that is mixed with the waste toner in the reclamation process. Such waste toner compositions can be recycled without first processing the waste material to separate the different colored toner particles. Thus, for example, a toner waste from the sump of a multi-color printing apparatus, including a mixture of cyan, magenta and yellow toner particles, can be formulated into a recycled black toner composition having printing and performance properties comparable to a new toner composition including only black toner particles. In such a formulation, the amount of black toner particles is adjusted by adding an amount of black powder particles to make the total amount of black particles equivalent in molecular composition. That adjustment also ensures that the color match for the remanufactured toner is the same or similar to the blackness of the fresh toner.

In embodiments, the reclaimed and screened toner particles can be remanufactured with fresh toner ingredients, for example, by meltmixing or extruding the fresh toner ingredients mixed with the reclaimed and screened toner particles followed by grinding, classifying, and screening. The fresh or second toner comprises toner constituents including, for example, a resin or resins, a colorant or colorants, and one or more optional additives such as a charge additive, a flow additive, and physical and melt mixtures thereof. In other embodiments, the second toner can further comprise recovered or recycled toner fines.

It is readily apparent that the reclaimed toner can be combined with the fresh toner constituents or fresh toner particles at various stages of the toner manufacturing process prior to, or subsequent to melt mixing, with the result that the finished reclaimed toner has physical characteristics and imaging properties substantially identical with what is observed when only fresh or new toner constituents are processed. The fresh toner constituents can be prepared in accordance with any conventional toner preparation process, for example as disclosed in U.S. Pat. Nos. 5,227,460; 5,376,494, 5,406,357, and 5,229,242, the disclosures of which are incorporated herein by reference in their entirety. The reclaimed toner particles can be combined with the fresh toner at, for example: the pellet grinding stage such as a mixture of reclaimed toner particles and fresh toner constituents as a mixture of extruder pellets; the external additive blending stage wherein fresh toner particles are combined with reclaimed toner particles and the mixture is subsequently treated with external surface additives; and at the screening stage wherein screened reclaim toner is combined with fresh toner constituents.

The reclaim and remanufacture processes enable highly reliable and economic procedures wherein reclaimed waste toner can be returned to a useful and active service life in amounts of from about 80 to about 99.9 percent based on the amount of waste toner initially reclaimed. This is even true in cases where the waste toner includes mixtures of two or more different toner compositions, such as mixtures of two or more different colored toner compositions.

In embodiments, the admixture of waste toner to fresh toner in the toner remanufacture process can be in a weight ratio of from about 0.5 to about 40 percent, preferably of from about 1 to about 20 percent, and more preferably from about 2 to about 10 percent or from about 5 to about 10 percent. Also, the reclaimed toner particles can be obtained from one or more printing machines, for example, from 1 to about 1,000,000 xerographic, liquid developer, and the like marking machines. The waste toner can be collected from the waste toner sumps or similar waste receptacles within the marking machines. In embodiments, the reclaimed toner particles are obtained from a plurality of different printing machines, such as at least 10 different printing machines, or at least 100 or at least 1,000 different printing machines. In particular, mixed used toner particles can be collected from the printing machines, which may be of the same manufacturer or from competitive products of same or similar design, such as from printing machines of different manufacturers.

The screening of reclaimed toner particles can be accomplished with, for example, a screen with a mesh size diameter cut off of between about 30 to about 50 microns, and preferably from about 40 to about 45 microns, and wherein the screened waste toner has a volume average particle size diameter, for example, preferably from about 8 microns to about 20, and more preferably about 8 to about 12 microns. The function of the screening of the reclaimed toner is primarily to remove extraneous debris, and which debris comprises, for example, paper fibers, paper particulates, ambient dust or soot, machine dirt, toner agglomerates and aggregates, carrier beads, carrier particulate spall or fragments, and other foreign debris, such as staples, paper clips, hair fibers, textile fibers, and the like, and mixtures thereof, and wherein the average particle size of said debris is greater than the mesh size diameter cut off range of the screen of greater than about 40 microns, for example, from about 40 to about 45 microns.

The screening process and screening equipment used to screen the waste toner maintains proper material composition, which is very close to the composition for fresh toner, that is, for example, there is insignificant loss of the principal toner constituents, such as carbon black, magnetite, colorant, resin, surface additives and other constituents in the waste toner during the screening process.

In embodiments, the mixing of the admixture of reclaimed waste toner and fresh toner ingredients can be accomplished by any suitable means, such as by mixing, melt mixing, solution mixing, and the like. Melt mixing is one preferred method, as it follows conventional toner composition preparation methods, and thus the reclamation processes can be readily incorporated into conventional processes. For example, the melt mixing of the admixture of reclaimed toner and fresh toner ingredients can be accomplished, for example, by physically mixing or blending the particles and then melt mixing, for example, in a ZSK 53 extruder or ZSK 40 or ZSK 25 or similar processing equipment with a melt temperature of about 250° F. to about 300° F., preferably from about 275° F. to about 325° F., and more preferably from about 300° F. to about 325° F., and wherein the toner extrudate has the desired composition of colorants and additives, such as the aforementioned charge additives, waxes, and the like, and the dispersion of the components of the remanufactured toner material, as measured by melt flow index, transmission electron microscopy and similar methods, is satisfactory. In illustrative embodiments, the remanufactured toner material, comprised of, for example, about 1 to about 10 weight percent of the reclaimed and screened toner particles, possesses a glass transition temperature of about 50° to about 60° C., and preferably about 55° C., and a melt flow index of from about 1 to about 35 g/10 minutes, and preferably from about 5 to about 20 g/10 minutes or from about 10 to about 16 g/10 minutes, and a triboelectric charge of about 10 to about 25 microcoulombs per gram, and preferably about 11 to about 21 microcoulombs per gram.

The second toner comprises toner constituents including, for example, a resin or resins, a colorant or colorants, and one or more optional additives such as a charge additive, a flow additive, reused or recovered toner fines, physical and melt mixtures thereof, and the like. The particle size of the second toner or toner constituents can be from several microns to several hundred microns in diameter, as desired.

Preferably, where the second toner composition is a different color from at least one of the toner compositions of the waste toner, such as where the waste toner is a mixture of two or more colored toner compositions, the second toner comprises a colorant that substantially masks the colorant of the waste toner. Thus, for example, the second toner composition preferably comprises a colorant material, or an amount of such colorant material, that masks the colorant material(s) of the waste toner so as to provide a desired color for the final toner composition. For example, where the waste toner is a mixture of black, cyan, magenta, and yellow toner particles, it is preferred that the second toner composition is a black toner composition, and that the black colorant is contained in such an amount that the final toner composition is black in color, and the color is unaffected by the presence of the black, cyan, magenta, and yellow colorants of the waste toner. The desired effect of color masking of the waste toner can further be ensured by using suitable amounts of the waste toner and the second toner in the mixing process, to ensure that the desired final color is obtained. See, for example, Table 3 below.

Toner compositions can be prepared by a number of known methods, such as admixing and heating resin particles obtained with the processes of the present disclosure, such as water soluble or insoluble styrene butadiene copolymers, polyesters and related polymeric materials in amounts of about 60 to 98 weight percent of the composition, pigment particles such as magnetite, carbon black, or mixtures thereof, and colored pigments such as cyan, yellow, magenta, green, brown, or mixtures thereof in amounts of about 2 to about 25 weight percent of the composition, and from about 0.5 percent to about 5 percent of charge enhancing additives, in a toner extrusion device, such as the ZSK40 available from Werner Pfleiderer, and removing the formed toner composition from the device. Subsequent to cooling, the toner composition is subjected to grinding utilizing, for example, a Sturtevant micronizer or AFG micronizer for the purpose of achieving toner particles with a volume median diameter of less than about 25 microns, and preferably of from about 6 to about 12 microns, which diameters can be determined by a suitable sizing device such as a Coulter Counter. Subsequently, the toner compositions can be classified utilizing, for example, a Donaldson Model B classifier for the purpose of removing toner fines, that is toner particles less than about 2-5 microns volume median diameter. Alternatively, the toner compositions are ground with a fluid bed grinder, and then classified using a classifier equipped with a classifier wheel in accordance with the present disclosure.

Illustrative examples of resins suitable for toner and developer compositions of the present disclosure include branched and unbranched styrene acrylates, styrene methacrylates, styrene butadienes, vinyl resins, including branched and unbranched homopolymers and copolymers of two or more vinyl monomers; vinyl monomers including, for example, styrene compounds, p-chlorostyrene, dienes, such as butadiene, isoprene, and myrcene; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; and the like. Preferred toner resins include styrene butadiene copolymers, mixtures thereof, and the like. Other preferred toner resins include styrene/n-butyl acrylate copolymers, PLIOLITES®; suspension polymerized styrene butadienes, reference U.S. Pat. No. 4,558,108, the disclosure of which is totally incorporated herein by reference. Suitable toner resins also include uncrosslinked and crosslinked polyesters, amorphous and crystalline polyester for example, comprising at least one diacid or anhydride and at least one diol, such as disclosed in commonly owned and assigned U.S. Pat. No. 5,376,494, the disclosure of which is incorporated herein in its entirety. In toner compositions, the resin particles are present in a sufficient but effective amount, for example from about 70 to about 90 weight percent. Thus, when 1 percent by weight of the charge enhancing additive is present, and 10 percent by weight of pigment or colorant, such as carbon black, is contained therein, about 89 percent by weight of resin is selected. Also, the charge enhancing additive may be coated on the pigment particle. When used as a coating, the charge enhancing additive is present in an amount of from about 0.1 weight percent to about 5 weight percent, and preferably from about 0.3 weight percent to about 1 weight percent.

Numerous well known suitable pigments or dyes can be selected as the colorant for the toner particles including, for example, carbon black like REGAL 330®, nigrosine dye, aniline blue, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be selected in attaining preferred toner properties.

When the pigment particles are comprised of magnetites, thereby enabling single component toners in some instances, which magnetites are a mixture of iron oxides (FeO. $Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

There can also be blended with the toner compositions of the present disclosure external additive particles including flow aid additives, which additives are usually present on the surface thereof. Examples of these additives include colloidal silicas, such as AEROSIL®, metal salts and metal salts of fatty acids inclusive of zinc stearate, calcium stearate, magnesium stearate, aluminum oxides, cerium oxides, titanium oxides, tin oxides, and mixtures thereof, which additives are generally present in an amount of from about 0.1 percent by weight to about 10 percent by weight, and preferably in an amount of from about 0.1 percent by weight to about 5 percent by weight. Several of the aforementioned additives are illustrated in U.S. Pat. Nos. 3,590,000 and 3,800,588, the disclosures of which are totally incorporated herein by reference.

With further respect to the present disclosure, colloidal silicas, such as AEROSIL®, can be surface treated with the charge additives in an amount of from about 1 to about 30 weight percent and preferably 10 weight percent followed by the addition thereof to the toner in an amount of from 0.1 to 10 and preferably 0.1 to 1 weight percent.

Also, there can be included in the toner compositions low molecular weight waxes, such as polypropylenes and polyethylenes commercially available from Allied Chemical and Petrolite Corporation, EPOLENE N-15® commercially available from Eastman Chemical Products, Inc., VISCOL 550-P®, a low weight average molecular weight polypropylene available from Sanyo Kasei K.K., and similar materials such as Canuba wax. The commercially available polyethylenes selected have a molecular weight of from about 1,000 to about 1,500, while the commercially available polypropylenes utilized for the toner compositions are believed to have a molecular weight of from about 4,000 to about 5,000. Many of the polyethylene and polypropylene compositions useful in the present disclosure are illustrated in British Patent No. 1,442,835, the disclosure of which is totally incorporated herein by reference. Other waxes include known fatty acid compounds, fatty acid salts such as zinc stearate, and the like compounds, and mixtures thereof.

The low molecular weight wax materials are optionally present in the toner composition or the polymer resin beads of the present disclosure in various amounts, however, generally these waxes are present in the toner composition in an amount of from about 1 percent by weight to about 15 percent by weight, and preferably in an amount of from about 2 percent by weight to about 10 percent by weight and may in embodiments function as fuser roll release agents.

Encompassed within the scope of the present disclosure are colored toner and developer compositions comprised of toner resin particles, carrier particles, the charge enhancing additives illustrated herein, and as pigments or colorants red, blue, green, brown, magenta, cyan and/or yellow particles, as well as mixtures thereof. More specifically, with regard to the generation of color images utilizing a developer composition with charge enhancing additives, illustrative examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present disclosure are achieved. In one embodiment, these colored pigment particles are present in the toner composition in an amount of from about 2 percent by weight to about 15 percent by weight calculated on the weight of the toner resin particles.

For the formulation of two component developer compositions, there are mixed with the toner particles carrier components, particularly those that are capable of triboelectrically assuming an opposite polarity to that of the toner composition. Accordingly, the carrier particles are selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. Other carrier components include selected ferrite compositions of manganese, magnesium, and strontium. The selected carrier particles can be used with or without a coating, the coating generally containing terpolymers of styrene, methylmethacrylate, and a silane, such as triethoxy silane, reference U.S. Pat. Nos. 3,526,533, 4,937,166, and 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000 microns, and in embodiments about 175 microns thereby permitting them to possess sufficient density and inertia to avoid adherence to the electrostatic images during the development process. The carrier component can be mixed with the toner composition in various suitable combinations, however, best results are obtained when about 1 to 5 parts per toner to about 10 parts to about 200 parts by weight of carrier are selected.

The toner composition of the present disclosure can be prepared by a number of known methods as indicated herein including extrusion melt mixing the toner resin particles, pigment particles or colorants, and a charge enhancing additive, followed by mechanical attrition. Other methods include those well known in the art such as spray drying, melt dispersion, emulsion aggregation, and extrusion processing. Also, as indicated herein the toner composition without the charge enhancing additive in the bulk toner can be prepared, followed by the addition of charge additive surface treated colloidal silicas.

The remanufactured toner compositions generated with the processes of the present disclosure may be selected for use in electrostatographic imaging apparatuses containing therein conventional photoreceptors providing that they are capable of being charged positively or negatively. Thus, the toner and developer compositions can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys. Other photoreceptors, including organic photoreceptors such as AMAT PR, may be selected.

The remanufactured toner compositions are usually jetted and classified subsequent to preparation to enable toner particles with a preferred average diameter of from about 5 to about 25 microns, more preferably from about 6 to about 12 microns, and most preferably from about 8 to about 10 microns. Also, the toner compositions preferably possess a triboelectric charge of from about 0.1 to about 2 femtocoulombs per micron as determined by the known charge spectrograph. Admix time for toners are preferably from about 5 seconds to 1 minute, and more specifically from about 5 to about 15 seconds as determined by the known charge spectrograph. These toner compositions with rapid admix characteristics enable, for example, the development of images in electrophotographic imaging apparatuses, which images have substantially no background deposits thereon, even at high toner dispensing rates in some instances, exceeding 20 grams per minute; and further, such toner compositions can be selected for high speed electrophotographic apparatuses, that is those exceeding 70 copies per minute.

Also, the toner compositions prepared, in embodiments, of the present disclosure possess desirable narrow charge distributions, optimal charging triboelectric values, preferably of from 10 to about 40, and more preferably from about 10 to about 35 microcoulombs per gram as determined by the known Faraday Cage methods with from about 0.1 to about 5 weight percent in one embodiment of the charge enhancing additive; and rapid admix charging times as determined in the charge spectrograph of less than 15 seconds, and more preferably in some embodiments from about 1 to about 14 seconds.

While the disclosure has been described in conjunction with the specific embodiments described above, it is evident that many alternatives, modifications and variations are apparent to those skilled in the art. Accordingly, the preferred embodiments of the disclosure as set forth above are intended to be illustrative and not limiting. Various changes can be made without departing from the spirit and scope of the disclosure.

An example is set forth herein below and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Example 1

In an illustrative procedure, waste toner is reclaimed from the sumps of several hundred xerographic printing machines, such as the Xerox Corporation models Xerox DocuColor® iGen3® Digital Production Press, Xerox DocuColor 2045, Xerox DocuColor 2060, and Xerox DocuColor 12. The reclaimed waste toner is a mixture of black, cyan, magenta, and yellow toner particles, where the relative ratio of different colored toner particles varies from machine to machine. The ratio of mixed color toner particles also depends on the type of job prints of a machine or machines. The reclaimed waste toner is screened using a turbo screener equipped with a 37 micron screen or 44 micron screen after a prescreen using a much coarser screener in the range of 11 mesh screen, a high efficiency cyclone for toner and air separation, a toner particle eductor system for crude metering of toner, and a dust collection system to remove excess air and fine particulates of the waste toner. Reclaimed toner laden with paper fibers, carrier particles, and other debris is pushed through the air ejector system to the turbo screener where paper debris and other debris are removed with the screen. The screened toner is passed through an efficient cyclone separator to extract toner particles from the air stream.

The screened toner is collected under the cyclone and is then mixed with a fresh toner composition of resin and colorant, and then processed in an extruder. In this Example, the screened toner is first mixed with a toner resin (here, polyester), and the mixture is preblended to help ensure uniform dispersion of the reclaimed waste toner in the resin. The waste toner/resin mixture is introduced into a first hopper of an extruder. Additional toner resin is introduced into a second hopper of the extruder, and a toner colorant (here, carbon black) is introduced into a third hopper of the extruder. The hopper controls are set such that the amounts of resin and colorant provided by the three hoppers together correspond to the amount of resin and colorant that would be used to make a new toner composition, i.e., without waste toner. The extrudate is further processed through an Alpine grinder, a blender, a classifier, and a screener.

For testing, three separate remanufactured toner compositions are prepared, with varying amounts of waste toner content. Specifically, the remanufactured toner compositions contain about 2% by weight waste toner, about 5% by weight waste toner, and about 10% by weight waste toner. For comparison, a conventional toner composition is also prepared, utilizing only new toner composition materials (i.e., no waste toner). The amounts of constituent components in each remanufactured toner composition is shown in Table 1 below.

TABLE 1

| | Control | 2% Waste | 5% Waste | 10% Waste |
|---|---|---|---|---|
| Polyester resin | 307.2 | | | |
| Polyester resin + Waste toner | | 311.9 | 319.0 | 330.8 |
| Crosslinked polyester resin | 72.8 | 73.9 | 75.6 | 78.4 |
| Regal 330 carbon black | 20.0 | 20.3 | 20.8 | 21.5 |
| Total Feed | 400.0 | 406.1 | 415.4 | 430.7 |

The resulting remanufactured toner compositions are reinstalled in a Xerox Corporation model Xerox DocuColor® iGen3® Digital Production Press copying device, and the toner properties and print quality are analyzed by conventional methods. The results observed for the remanufactured toner compositions obtained by mixing reclaimed toner with fresh toner ingredients, or alternatively, by preblending reclaimed toner with fresh toner ingredients followed by extrusion are shown in Table 2.

TABLE 2

| | Control | 2% Waste | 5% Waste | 10% Waste |
|---|---|---|---|---|
| MFI (FITZ milled) | 13.1 ± 3 | 15.1 | 13.9 | 13.6 |
| MFI (blended) | 9.0 ± 3 | 10.8 | 10.6 | 9.1 |
| Triboelectric charge (μC/g) | 32.63 | 32.63 | 32.76 | — |
| G' (10 R/sec) | $4.8 \times 10^4$ | $4.5 \times 10^4$ | $4.6 \times 10^4$ | $4.9 \times 10^4$ |
| Ge | $1.5 \times 10^4$ | $2.0 \times 10^4$ | $2.0 \times 10^4$ | $2.0 \times 10^4$ |

In the above Table, G' represents the elastic modulus or shear modulus or the modulus of rigidity of the toner material. This characteristic represents the deformation behavior of the toner material when it is subjected to shear stress. G' relates to energy storage properties of the toner material. Ge represents the entanglement modulus of the toner material, which is the elastic modulus of the material at very low or near zero frequency.

The results demonstrate an unexpected result that melt mixing of reclaimed toner, specifically a mixture of different colored toner particles, with fresh toner ingredients is, for example, important to match the properties of the control such as triboelectric properties, conductivity and high admix performance. Bench test results indicate that we can achieve machine image quality such as development, toner mass per unit area, background scatter, line edge quality, solid area quality and the like.

Table 3 below presents color-matching data for the remanufactured toner compositions and the control toner composition. The Table presents the color parameter L* for each composition, as a function of increasing TMA (toner mass per unit area, expressed in mg/cm$^2$).

TABLE 3

| TMA | L*Control | L*2% | L*5% | L*10% |
|---|---|---|---|---|
| 0.15 | 54.78 | 53.95 | 59.58 | 55.97 |
| 0.25 | 33.66 | 33.45 | 38.84 | 34.84 |
| 0.35 | 20.32 | 20.92 | 21.37 | 22.39 |
| 0.45 | 13.33 | 12.08 | 13.18 | 15.45 |
| 0.55 | 7.79 | 8.5 | 7.83 | 10.24 |
| 0.65 | 5.99 | 7.15 | 6.34 | 8.17 |
| 0.75 | 5.32 | 5.24 | 5.43 | 6.68 |
| 0.85 | 4.96 | 5.06 | 5.08 | 5.72 |
| 0.95 | 4.9 | 4.87 | 4.98 | 5.38 |
| 1 | 4.86 | 4.87 | 4.95 | 5.06 |
| 1.1 | 4.86 | 4.76 | 4.92 | 4.94 |

These results show that the remanufactured toner compositions and the control toner composition are very closely color matched, despite the different constituent materials included and the different manufacturing methods.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A process of reclaiming multiple different colored toners comprising:

collecting waste toner;

screening the collected waste toner;

meltmixing the screened waste toner with a second toner, and extruding, grinding and classifying the mixed toner product, wherein the collected waste toner comprises a mixture of at least two different colored toners, and wherein the second toner comprises colored toner particles of a type and quantity sufficient to substantially mask the color of the collected waste toner.

2. A process in accordance with claim 1, further comprising blending at least one surface additive with the mixed toner product.

3. A process in accordance with claim 1, wherein the mixing of screened waste toner to second toner is in a ratio of from about 0.5 to about 40 weight percent based on the total weight of the mixture.

4. A process in accordance with claim 1, wherein the collected waste toner comprises a mixture of black, cyan, magenta, and yellow toner particles.

5. A process in accordance with claim 1, wherein the collected waste toner comprises at least one toner selected from the group consisting of a cyan, magenta, and yellow toner particles, and said second toner is a black toner.

6. A process in accordance with claim 1, wherein the collected waste toner is at least one of a different color or different composition from said second toner.

7. A process in accordance with claim 1, wherein the waste toner is recovered from at least one printing machine.

8. A process in accordance with claim 7, wherein said at least one printing machine comprises from 100 to about 1,000,000 machines.

9. A process in accordance with claim 7, wherein the waste toner is collected from the waste toner sump in said at least one printing machine.

10. A process in accordance with claim 1, wherein the screening is accomplished with a screen with a mesh size diameter from about 30 to about 50 micron, wherein the screened waste toner has a volume average diameter particle size of less than about 5 to about 20 microns, and wherein the second toner has a volume average diameter particle size of about 8 to about 14 microns.

11. A process in accordance with claim 10, wherein the screening is accomplished with a turbo screener.

12. A process in accordance with claim 1, wherein there is removed from the waste toner by said screening extraneous debris selected from the group consisting of paper fibers, paper particulates, ambient dust, machine dirt, toner agglomerates and aggregates, carrier particle spall, paper clips, staples, hair fibers, textile fibers, and mixtures thereof, and wherein the average particle size of said debris is greater than about 30 to about 50 microns.

13. A process in accordance with claim 1, wherein the mixing is accomplished in an extruder or a rubber mill.

14. A process in accordance with claim 1, wherein the grinding and classifying are accomplished in a fluid bed jet mill.

15. A process in accordance with claim 1, wherein there results remanufactured toner particles with a tribo electric charge of from about 11 to about 21 microcoulombs per gram, and admix of about 5 to about 15 seconds, a glass transition temperature of about 50-60° C., and a melt index of about 3 to about 10 gram per 10 minutes.

16. A process in accordance with claim 1, wherein the screened toner is reclaimed in amounts of from about 80 to about 99.99 percent based on the weight of the waste toner collected, and wherein the screening removes extraneous debris from the reclaimed toner in amounts of about 0.01 to about 20 weight percent of the waste toner collected.

17. A process in accordance with claim 1, wherein the second toner comprises toner constituents selected from the group consisting of a resin or resins, a colorant or colorants, a charge additive, a flow additive, recovered or recycled toner fines, and physical and melt mixtures thereof.

18. A printing machine comprising a development system comprised of a developer comprised of the mixed toner product obtained from the process of claim 1.

19. A process comprising:

collecting waste toner from at least one xerographic printing machine, wherein the collected waste toner comprises a mixture of at least two different colored toners;

screening the collected waste toner to remove extraneous debris and to afford screened waste toner;

extruding in an extruder apparatus, in a weight ratio of about 1 to about 20 weight percent, the screened waste toner in admixture with a second toner comprising colored toner particles of a type and Quantity sufficient to substantially mask the color of the collected waste toner, a resin and a colorant, to provide a mixed product; and grinding and classifying the melt mixed product to provide remanufactured toner particles with a glass transition temperature of about 53° to about 58° F.

20. A process comprising:

collecting waste toner from at least one printing machine, wherein the collected waste toner comprises a mixture of at least two different colored toners;

screening the collected waste toner to remove extraneous debris to afford screened waste toner; and combining the screened waste toner with fresh toner constituents comprising colored toner particles of a type and Quantity sufficient to substantially mask the color of the collected waste toner, a resin and a colorant, and wherein said combining is accomplished at a stage in toner manufacturing processing selected from the group consisting of pellet grinding, external additive blending, and screening, to provide remanufactured toner particles.

* * * * *